US011088473B2

(12) United States Patent
Zäuner et al.

(10) Patent No.: US 11,088,473 B2
(45) Date of Patent: Aug. 10, 2021

(54) OVERVOLTAGE PROTECTION DEVICE WITH AT LEAST ONE OVERVOLTAGE PROTECTION UNIT, CONSISTING OF A SOCKET PART AND A PLUG PART WHICH CAN BE CONNECTED TO THE SOCKET PART

(71) Applicant: DEHN SE + CO KG, Neumarkt/Opf. (DE)

(72) Inventors: Edmund Zäuner, Berching/Pollanten (DE); Stefan Dietweger, Nuremberg (DE); Sascha Ludewig, Neumarkt (DE)

(73) Assignee: DEHN SE + CO KG, Neumarkt/Opf. (DE)

( * ) Notice: Subject to any disclaimer, the term of this patent is extended or adjusted under 35 U.S.C. 154(b) by 0 days.

(21) Appl. No.: 16/969,069

(22) PCT Filed: Jan. 30, 2019

(86) PCT No.: PCT/EP2019/052224
§ 371 (c)(1),
(2) Date: Aug. 11, 2020

(87) PCT Pub. No.: WO2019/166171
PCT Pub. Date: Sep. 6, 2019

(65) Prior Publication Data

US 2021/0036443 A1 Feb. 4, 2021

(30) Foreign Application Priority Data

Feb. 27, 2018 (DE) ..... 102018104469.0
Mar. 29, 2018 (DE) ..... 102018107604.5

(51) Int. Cl.
*H01R 9/26* (2006.01)
*H01R 4/2433* (2018.01)

(52) U.S. Cl.
CPC ..... *H01R 9/2641* (2013.01); *H01R 4/2433* (2013.01)

(58) Field of Classification Search
CPC .. H01R 9/2425; H01R 4/2433; H01R 4/2404; H01R 9/2641
See application file for complete search history.

(56) References Cited

U.S. PATENT DOCUMENTS 7,201,601 B2 * 4/2007 Lappohn ..... H01R 4/2433 439/404
7,234,961 B2 6/2007 Arlitt et al. ..... 439/410
(Continued)

FOREIGN PATENT DOCUMENTS

DE 3708782 A1 9/1988 ..... H01R 4/24
DE 102014007352 A1 9/2015 ..... H01R 4/24
(Continued)

OTHER PUBLICATIONS

The Notification Concerning Transmittal of International Preliminary Report on Patentability (Chapter I of the Patent Cooperation Treaty), in English, dated Sep. 3, 2020, which was issued by the International Bureau of WIPO in Applicant's corresponding international PCT application having Serial No. PCT/EP2019/052224, filed on Jan. 30, 2019.
(Continued)

*Primary Examiner* — Jean F Duverne
(74) *Attorney, Agent, or Firm* — Bodner & O'Rourke, LLP; Gerald T. Bodner; Christian P. Bodner

(57) ABSTRACT

The invention relates to an overvoltage protection device with at least one overvoltage protection unit, consisting of a socket part and a plug part which can be connected to the socket part and which receives means for protecting against an overvoltage, wherein insulated electric conductors can be introduced into the socket part, said electric conductors being contacted using vampire or cutting clamps, thereby
(Continued)

Figure 1A:
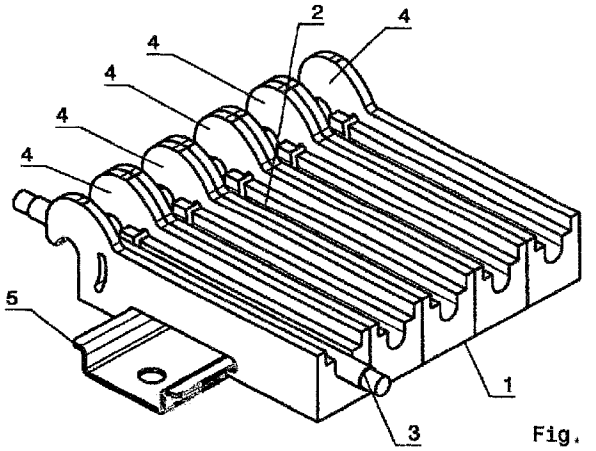

penetrating the conductor insulation, and with contact surfaces which can be found on the socket part and which correspond to mating contact surfaces on the base of the plug part. According to the invention, the socket part is made of multiple parts consisting of a base part and a lever part. The base part is designed as a marble panel and has multiple parallel grooves for inserting and receiving the insulated electric conductors. On one face of the base part, hook-shaped protrusions are provided parallel to the grooves. The lever part has axle stubs, which engage into the hook-shaped protrusions, on one lever end. The lever part has at least one cutting clamp on the lever part lower face facing the marble panel and in the vicinity of the axle stubs, wherein the cutting clamp leads to a plug contact which can be found in the lever part and which can be accessed from the upper face of the lever part in order to receive the plug part.

11 Claims, 2 Drawing Sheets

(56) References Cited

U.S. PATENT DOCUMENTS

| | | | | |
|---|---|---|---|---|
| 9,380,721 | B2 * | 6/2016 | Hopf | H01R 9/2425 |
| 9,780,463 | B2 | 10/2017 | Seitz et al. | |

FOREIGN PATENT DOCUMENTS

| | | | | |
|---|---|---|---|---|
| EP | 1764871 | A1 | 3/2007 | H01R 12/08 |
| EP | 1764871 | B1 | 4/2008 | H01R 12/08 |
| WO | WO 9904455 | A1 | 1/1999 | H01R 4/24 |

OTHER PUBLICATIONS

The English translation of the International Preliminary Report on Patentability (Chapter I of the Patent Cooperation Treaty), dated Aug. 27, 2020, which was issued by the International Bureau of WIPO in Applicant's corresponding international PCT application having Serial No. PCT/EP2019/052224, filed on Jan. 30, 2019.

The Written Opinion of the International Searching Authority, in English, dated Apr. 15, 2019, which was issued by the International Bureau of WIPO in Applicant's corresponding international PCT application having Serial No. PCT/EP2019/052224, filed on Jan. 30, 2019.

The International Search Report, in English, dated Apr. 15, 2019, which was issued by the International Bureau of WIPO in Applicant's corresponding international PCT application having Serial No. PCT/EP2019/052224, filed on Jan. 30, 20198.

* cited by examiner

OVERVOLTAGE PROTECTION DEVICE WITH AT LEAST ONE OVERVOLTAGE PROTECTION UNIT, CONSISTING OF A SOCKET PART AND A PLUG PART WHICH CAN BE CONNECTED TO THE SOCKET PART

The invention is based on an overvoltage protection device with at least one overvoltage protection unit, composed of a base part and a plug part connectable to the base part, which accommodates means for protecting against overvoltage, wherein insulated electrical conductors can be introduced into the base part, which are contacted by means of vampire or cutting clamps while penetrating the conductor insulation, and contact surfaces located in the base part, which correspond to mating contact surfaces on the bottom of the plug part, according to claim 1.

From DE 10 2014 007 352 A1, an overvoltage protection device with at least one overvoltage protection unit, composed of a substantially U-shaped base part and a plug part connectable to the base part, is already known. The plug part accommodates means for protecting against overvoltage, wherein insulated electrical conductors are contacted on or in the plug part by means of vampire or cutting clamps, as well as openings or break-throughs formed in the base part for accommodating conductors.

In one embodiment of DE 10 2014 007 352 A1, a snap-in plate or a plurality of snap-in webs can be inserted into the base part. The snap-in plate or the snap-in webs may be an integral part of the base part, i.e. may be delivered together and pre-assembled with the base part. In the initial position, the snap-in plate or the snap-in webs is/are in a condition allowing the conductors in question to be pushed in through the openings in the base part or to be pushed through in the case of a so-called V wiring.

The snap-in plate and/or the snap-in webs has/have contact surfaces oriented toward the plug part, and cutting surfaces pointing toward the conductors, namely in such a manner that, during pressing or snapping in, the cutting surfaces penetrate the conductor insulation and contact the respective conductors so that an electrical connection may be established between the respective contact surfaces and the respective conductor.

The actual plug part is then inserted into the preliminary construction of the base part with the snap-in plate and conductors already contacted there, and via mating contact surfaces located on its bottom enters into electrical connection with the contact surfaces of the plug part.

It has been shown that the solution for a tool-free contacting of conductors according to DE 10 2014 007 352 A1 entails considerable advantages in mounting overvoltage protection units, since an incorrect wiring is almost excluded and a loosening of the electrical contacts occurring due to setting of screw and clamp connections can be avoided. The point-shaped contacts utilized in the mentioned state of the art, however, feature the disadvantage in the case of a surge current load that the contact tips burn off due to the current flow and the thermal energy developing on this occasion. The consequence is contact uncertainty which is usually not or normally identified too late when a damage is recognized.

The use of cutting clamps as quick connection technology in the field of telecommunication networks for switching on cable cores in a manner free from solder, screws and stripping considering the currents to be carried may not be performed, however, at least not without supportive tools in the field of overvoltage protection. Thus, however, the desired advantage of a tool-free and quick assembly is no longer given.

From the aforementioned, it is therefore a task of the invention to propose an advanced overvoltage protection device with at least one overvoltage protection unit, composed of a base part and a plug part connectable to the base part, which accommodates means for overvoltage protection, said overvoltage protection device enabling a tool-free and quick installation of the overvoltage protection unit, in particular for top hat rail applications, with the achieved cutting and clamping connection guaranteeing at the same time a surge current resistant, reliable and permanent contacting.

The solution of the task of the invention is performed by the feature combination according to claim 1, with the dependent claims representing at least appropriate configurations and further developments.

Accordingly, an overvoltage protection device is taken as a basis, which has at least one overvoltage protection unit.

The overvoltage protection unit in question is composed of at least one base part and at least one plug part connectable to the base part.

The plug part will then accommodate the actual means for overvoltage protection, such as spark gaps, varistors or the like.

Insulated electrical conductors can be introduced into the base part, which are contacted by means of vampire or cutting clamps while penetrating the conductor insulation.

On the base part, there are contact surfaces corresponding to mating contact surfaces on the bottom of the plug part.

Overvoltage protection devices composed of a base part or basic part, which is suitable for top hat rail assembly and accommodates the actual overvoltage protection units in the form of plug parts, are part of the state of the art. Reference should be made here to the current overvoltage protection units of company DEHN+SÖHNE GmbH+Co. KG, Neumarkt/Opf., under www.dehn.de.

The initial wiring should be carried out with respect to the solution of the invention in a simpler and safe contact manner, and namely also in the case of a so-called V wiring. The electrical connection to be created should guarantee high operational safety and be available reliably over a long period of time.

In contrast to the state of the art, the base part is not configured in one piece as a pre-manufactured constructional unit of base plate and snap-in plate.

Rather, the base part is realized to be multi-part and is composed of a bottom part and a lever part. The bottom part is configured as a core plate and has a plurality of grooves extending in parallel for inserting and accommodating the insulated electrical conductors.

On one side of the bottom part and extending in parallel to the grooves, hook-shaped protrusions are provided.

At one lever end, the lever part has axle stubs engaging into the hook-shaped protrusions.

On its lower side pointing toward the core plate and close to the axle stubs, the lever part has at least one cutting clamp. The cutting clamp leads to a plug contact located in the lever part, which plug contact is accessible from the upper side of the lever part for accommodating the plug part and for contacting it.

In the core plate, a pair of hook-shaped protrusions is provided per groove, wherein each groove has a lever part associated.

The groove depth substantially corresponds to the diameter of the conductor including the insulation.

When the lever part is actuated, the respective cutting clamp cuts through the insulation of the respectively inserted conductor and displaces the insulation so that the result is a contact with the conductor over a large area and at the circumferential side.

In one configuration of the invention, a window-like breakthrough for recognizing the position of the conductor and cutting clamp may be formed in the lateral surface of the bottom part.

In a preferred embodiment of the invention, a recess having a clamping lug for top hat rail assembly is provided at the underside of the bottom part.

The lever part can be hung into the hook-shaped protrusions of the bottom part with its axle stubs.

The conductor can therefore be inserted in a completely interference-free manner in the bottom part and into the respective groove provided therein, and subsequently the lever part can be hung up using the hook-shaped protrusions.

Due to the resulting lever action and the formation of the cutting clamp located close to the axis of rotation, it is possible with a very low leverage to connect in this way, as usual in low-voltage technology, also cutting clamps of correspondingly strong dimensions to conductors even of larger diameter in cutting clamp technology. Using tools for increasing the force is not required.

The respective cutting clamps preferably are configured as a stamped and bent part and attached to the underside of the lever part in a longitudinal recess. This attachment may be performed by interlocking, screwing or riveting. In the area of the breakthrough in the lever part for the respective plug contact of the plug part, the stamped and bent part then has a complementary recess encompassing the plug contact and providing the necessary surge current-resistant contacting.

In their cutting area, the cutting clamps may have protrusions or lugs extending toward the groove sidewalls, which engage into guiding recesses within the bottom part when the closing movement of the lever part toward the bottom part is executed. This prevents that the cutting clamps perform an evasive movement which would generate an insufficient electrical connection.

The underside of the lever part may have a setback portion oriented into the longitudinal direction, which is complementary to a longitudinal recess in the bottom part, which recess extends in parallel to the respective groove. Hereby, the lever is guided when closing, and a form closure between the lever part and the bottom part is achieved when the closing movement is completed.

As far as the assembly is concerned, the bottom part according to the invention is first snapped onto a top hat rail, for example, in the area of a domestic junction box.

The cores of the existing cable are inserted into the grooves provided for L1, L2, L3, N or PE.

The lever part in question including the integrated cutting clamp is installed per core. By the rotational movement received by the cutting clamp, the insulation of the concerned core is cut and the conductor is contacted. In the end position, the lever part interlocks with the bottom part.

In the next step, the plug part or a module of several plug parts is installed. The corresponding electrical installation may then be put into operation.

The invention will be explained in more detail below using an exemplary embodiment and with reference to Figures.

Figure 2:
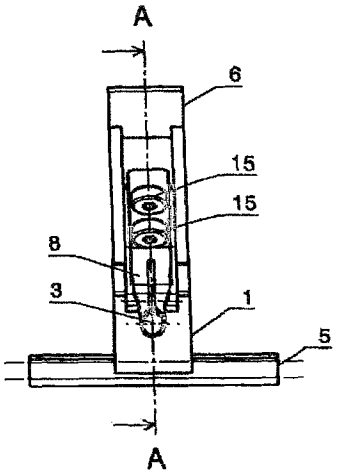
Figure 3:
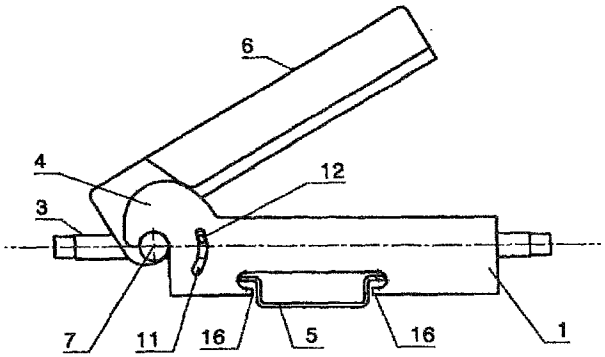
Figure 4:
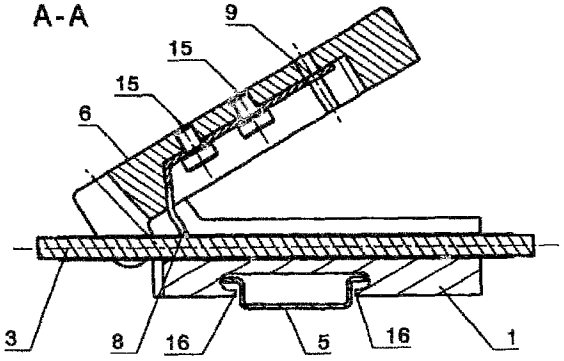
Figure 5:
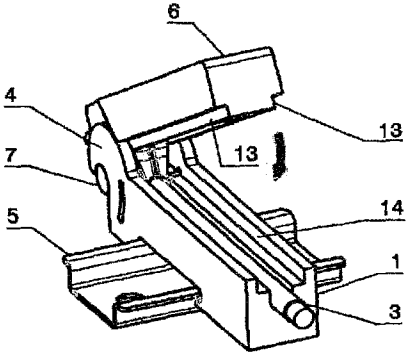

In this case, shown are in:

FIGS. 1*a*-1*d* an exemplary assembly sequence using the overvoltage protection device according to the invention with the bottom part and lever part;

FIG. 2 a front view of an arrangement of a bottom part with the attached lever part mounted to a top hat rail, and a conductor inserted prior to executing the lever movement for forming the insulation displacement;

FIG. 3 a representation similar to that according to FIG. 2, but in a lateral view;

FIG. 4 a lateral sectional representation along line A-A according to FIG. 2 in the state where the cutting edge of the cutting clamp contacts the cable or the core; and FIG. 5 a perspective representation of the overvoltage protection device according to the invention in a state similar to that of FIG. 4.

The overvoltage protection device according to the invention is composed of a multi-part base part according to the Figures.

First, a bottom part 1 configured as a core plate is present.

In the bottom part, a plurality of grooves 2 extending in parallel are present for inserting and receiving insulated electrical conductors 3.

At one end of the bottom part 1 and in parallel to the grooves 2, hook-shaped protrusions 4 are provided.

At its underside, the bottom part 1 is provided with a recess for enabling it to be snapped onto a top hat rail 5.

Furthermore, lever parts 6 are present, with axle stubs 7 being formed at one lever end.

These axle stubs 7 are capable of engaging into the hook-shaped protrusions 4 so that a detachable articulated connection is the result.

At its underside pointing toward the core plate or toward the bottom part 1 and close to or nearby the axle stubs 7, the lever part 6 has at least one cutting clamp 8.

The cutting clamp 8 in question leads to a plug contact 9 located in the lever part 6, which plug contact is accessible from the upper side of the lever part 6 for receiving the plug part 10.

The plug contact 9 may be an integral part of a one-piece punched and bent part which has the cutting clamp 8 at one end and the mentioned plug contact 9 at the other end.

Figure 1B:
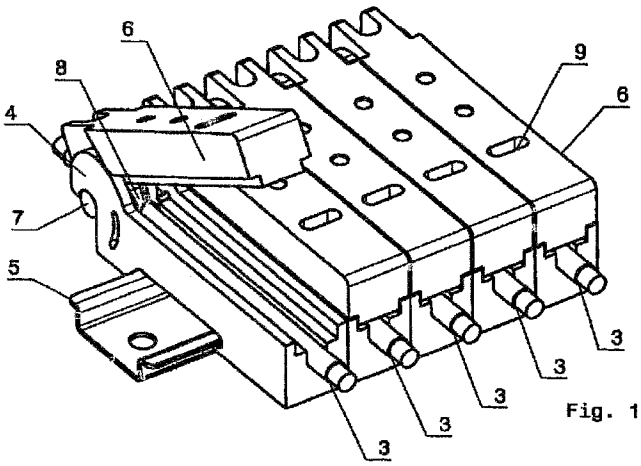
Figure 1C:
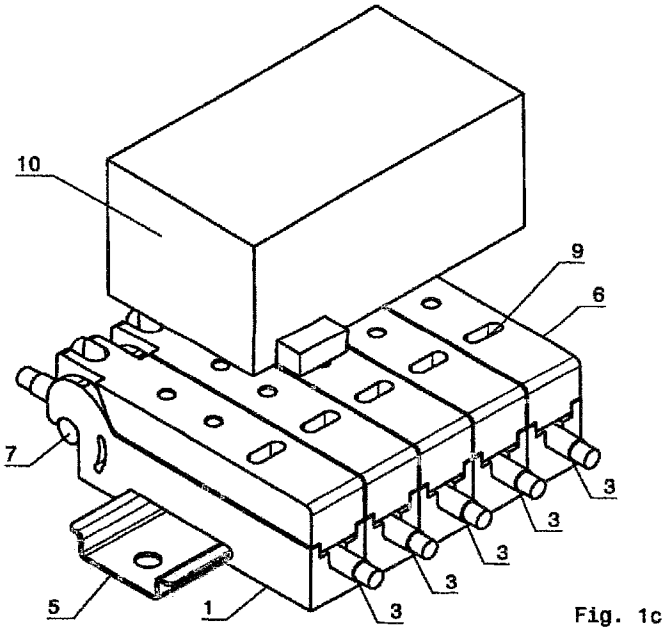
Figure 1D:
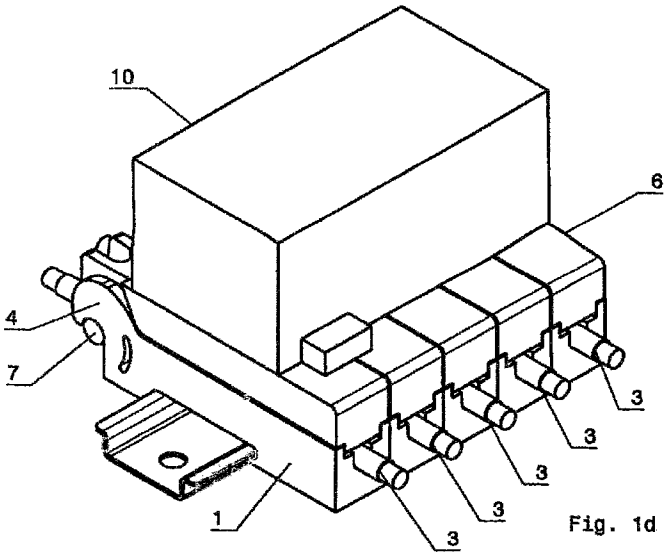

A pair of hook-shaped protrusions 4 is provided per groove 2 in the core plate 1, wherein each groove also has a lever part 6 associated as can be understood from the sequence of FIGS. 1*b* to 1*d*.

As can be understood from the view according to FIG. 2, the depth of the respective groove 2 is realized to be corresponding substantially to the diameter of the conductor 3.

Thus, the conductor lies in the groove in a well embedded manner.

The cutting clamp 8 has two cutting portions on the underside with a longitudinal slot following thereto. The cutting portions have a cutting edge or a chamfer in order to cut through and displace the insulation layer located on the conductor 3 when the cutting clamp enters so that the desired possibly large-area and circumferential electrical contact between the cutting clamp and the conductive core may be established and the surge current carrying capacity may be met according to the requirements.

In the lateral surfaces of the bottom part 1, a guiding recess may in each case be present.

Protrusions 12 of the cutting clamp 8 in question, which reach toward the groove sidewalls, engage into these respective guiding recesses. Hereby, the cutting clamp is prevented from evading when the closing movement is executed by pressing down the lever part toward the base part, and the contact reliability is increased.

The underside of the lever part 6 has a setback portion 13 extending in the longitudinal direction and being complementary to a longitudinal recess 14 in the bottom part 1 so that the lever is guided when closing and a form closure is given between the lever part 6 and the bottom part 1 when the closing movement (see arrow representation according to FIG. 5) is completed.

As already explained, the respective cutting clamp 8 may be configured as a punched and bent part and is attached at the underside of the lever part 6 in a gap or longitudinal recess provided there.

The attachment may be performed by means of screws or rivets 15.

The fixing of the bottom part on the top hat rail 5 by means of the clamping lugs 16 can in particular be understood with reference to FIGS. 3 and 4.

The solution according to the invention results in a secure and reliable insulation displacement connection and has the advantages of a screwless clamping such as, for example, resistance to vibration.

The contacting is performed by a bilateral insulation displacement starting from a position in the representation according to FIG. 2.

Due to the lever mechanism, larger forces for cutting through the insulation and contacting the core are not required so that the solution according to the invention is also applicable to larger diameters. The cutting edge of the cutting clamp is configured such that the insulation is first cut and displaced by a chamfer, and subsequently a large-area contact point freed from insulating material is present.

The invention claimed is:

1. An overvoltage protection device with at least one overvoltage protection unit, composed of a base part and a plug part connectable to the base part, which accommodates means for protecting against overvoltage, wherein insulated electrical conductors can be introduced into the base part, which are contacted by means of vampire or cutting clamps while penetrating the conductor insulation, and contact surfaces located in the base part, which correspond to mating contact surfaces on the bottom of the plug part, characterized in that the base part is realized to be multi-part and is composed of a bottom part (1) and a lever part (6), wherein the bottom part (1) is configured as a core plate and has a plurality of grooves (2) extending in parallel for inserting and accommodating the insulated electrical conductors (3), and on one side of the bottom part (1) and extending in parallel to the grooves (2), hook-shaped protrusions (4) are provided, furthermore at one lever end, the lever part (6) has lateral axle stubs (7) engaging into the hook-shaped protrusions (4), on its lower side pointing toward the core plate (1) and close to the axle stubs (7), the lever part (6) has at least one cutting clamp (8), wherein the cutting clamp (8) leads to a plug contact or a mating plug contact (9) located in the lever part (6), which plug contact is accessible from the upper side of the lever part (6) for accommodating the plug part (10), and wherein in the cutting area, the cutting clamps (8) have protrusions (12) extending toward groove sidewalls of the grooves (2), wherein the protrusions (12) engage into guiding recesses within the bottom part (1) when the closing movement of the lever part (6) toward the bottom part (1) is executed.

2. The overvoltage protection device according to claim 1, characterized in that in the core plate (1), a pair of hook-shaped protrusions (7) is provided per groove (2), and each groove (2) has a lever part (6) associated.

3. The overvoltage protection device according to claim 1, characterized in that the groove depth substantially corresponds to the diameter of the conductor (3) including the insulation.

4. The overvoltage protection device according to claim 1, characterized in that when the lever part (6) is actuated, the respective cutting clamp (8) cuts through and displaces the insulation of the respectively inserted conductor (3) and contacts the conductor core over a large area and at the circumferential side.

5. The overvoltage protection device according to claim 1, characterized in that a window-like breakthrough for recognizing the position of the conductor (3) and cutting clamp (8) is formed in the lateral surface of the bottom part (1).

6. The overvoltage protection device according to claim 1, characterized in that a recess having clamping lugs (16) for assembly to a top hat rail (5) is provided at the underside of the bottom part (1).

7. The overvoltage protection device according to claim 1, characterized in that the lever part (6) can be hung into the hook-shaped protrusions (4) of the bottom part (1) with its axle stubs (7).

8. The overvoltage protection device according to claim 1, characterized in that the respective cutting clamp (8) is configured as a punched and bent part and is attached at the underside of the lever part (6) in a longitudinal recess.

9. The overvoltage protection device according to claim 1, characterized in that the underside of the lever part (6) has a setback portion (13), which is complementary to a longitudinal recess (14) in the bottom part (1), which recess extends in parallel to the respective groove (2), so that the lever is guided when closing, and a form closure between the lever part (6) and the bottom part (1) is given when the closing movement is completed.

10. An overvoltage protection device with at least one overvoltage protection unit, composed of a base part and a plug part connectable to the base part, which accommodates means for protecting against overvoltage, wherein insulated electrical conductors can be introduced into the base part, which are contacted by means of vampire or cutting clamps while penetrating the conductor insulation, and contact surfaces located in the base part, which correspond to mating contact surfaces on the bottom of the plug part, characterized in that the base part is realized to be multi-part and is composed of a bottom part (1) and a lever part (6), wherein the bottom part (1) is configured as a core plate and has a plurality of grooves (2) extending in parallel for inserting and accommodating the insulated electrical conductors (3), and on one side of the bottom part (1) and extending in parallel to the grooves (2), hook-shaped protrusions (4) are provided, furthermore at one lever end, the lever part (6) has lateral axle stubs (7) engaging into the hook-shaped protrusions (4), on its lower side pointing toward the core plate (1) and close to the axle stubs (7), the lever part (6) has at least one cutting clamp (8), wherein the cutting clamp (8) leads to a plug contact or a mating plug contact (9) located in the lever part (6), which plug contact is accessible from the upper side of the lever part (6) for accommodating the plug part (10), and wherein the underside of the lever part (6) has a setback portion (13), which is complementary to a longitudinal recess (14) in the bottom part (1), which recess extends in parallel to the respective groove (2), so that the lever is guided when closing, and a form closure between the lever part (6) and the bottom part (1) is given when the closing movement is completed.

11. An overvoltage protection device with at least one overvoltage protection unit, composed of a base part and a plug part connectable to the base part, which accommodates means for protecting against overvoltage, wherein insulated electrical conductors can be introduced into the base part, which are contacted by means of vampire or cutting clamps while penetrating the conductor insulation, and contact surfaces located in the base part, which correspond to mating contact surfaces on the bottom of the plug part, characterized in that the base part is realized to be multi-part and is composed of a bottom part (1) and a lever part (6), wherein the bottom part (1) is configured as a core plate and has a plurality of grooves (2) extending in parallel for inserting and accommodating the insulated electrical conductors (3), and on one side of the bottom part (1) and extending in parallel to the grooves (2), hook-shaped protrusions (4) are provided, furthermore at one lever end, the lever part (6) has lateral axle stubs (7) engaging into the hook-shaped protrusions (4), on its lower side pointing toward the core plate (1) and close to the axle stubs (7), the lever part (6) has at least one cutting clamp (8), wherein the cutting clamp (8) leads to a plug contact or a mating plug contact (9) located in the lever part (6), which plug contact is accessible from the upper side of the lever part (6) for accommodating the plug part (10), and wherein when the lever part (6) is actuated, the respective cutting clamp (8) is configured such that it can cut through and displace the insulation of the respective inserted conductor (3) by means of a chamfer and contacts the conductor core over a large area and at the circumferential side.

* * * * *